US008100609B2

(12) United States Patent
Wilson

(10) Patent No.: US 8,100,609 B2
(45) Date of Patent: Jan. 24, 2012

(54) SEDIMENT BARRIER

(76) Inventor: Ken Wilson, Naples, FL (US)

( * ) Notice: Subject to any disclaimer, the term of this patent is extended or adjusted under 35 U.S.C. 154(b) by 129 days.

(21) Appl. No.: 12/378,159

(22) Filed: Feb. 11, 2009

(65) Prior Publication Data

US 2009/0257827 A1 Oct. 15, 2009

Related U.S. Application Data

(60) Provisional application No. 61/065,383, filed on Feb. 11, 2008.

(51) Int. Cl.
*E02D 17/20* (2006.01)

(52) U.S. Cl. ..... 405/302.6; 405/302.7; 405/15; 405/16

(58) Field of Classification Search ..... 405/15–18, 405/21, 110, 111, 115, 302.4, 302.6, 302.7; 210/162, 170.01, 170.03
See application file for complete search history.

(56) References Cited

U.S. PATENT DOCUMENTS

| | | | | |
|---|---|---|---|---|
| 5,405,217 | A * | 4/1995 | Dias et al. | 405/25 |
| 2006/0133897 | A1 * | 6/2006 | Allard et al. | 405/43 |
| 2007/0003369 | A1 * | 1/2007 | Hanson et al. | 405/19 |
| 2007/0193129 | A1 * | 8/2007 | Mansfield | 52/79.9 |
| 2008/0019780 | A1 * | 1/2008 | Hastings | 405/302.6 |

* cited by examiner

*Primary Examiner* — David Bagnell
*Assistant Examiner* — Sean Andrish
(74) *Attorney, Agent, or Firm* — Pauley Petersen & Erickson

(57) ABSTRACT

An apparatus and method for controlling water flow, soil erosion, and/or sediment flow in and around a construction site. The apparatus includes a three-dimensional, water-permeable polypropylene filled geotextile pocket that is secured to the ground with a supporting structure. The apparatus includes a tail portion that is placed flat against the ground, facing upstream against the direction of water flow. The tail portion can be secured with pins that provide protection against movement of the tail portion and reduce an amount of sediment passing under the apparatus.

17 Claims, 3 Drawing Sheets

SEDIMENT BARRIER

CROSS REFERENCE TO RELATED APPLICATION

This application claims the benefit of U.S. Provisional application No. 61/065,383, filed 11 Feb. 2008, the disclosure of which earlier application is incorporated by reference herein and made a part hereof, including but not limited to those portions which specifically appear in this application.

BACKGROUND OF THE INVENTION

1. Field of the Invention

This invention relates to sediment barriers. This invention relates to an apparatus and method for controlling water flow, soil erosion and/or sediment flow at, for example, a construction site.

2. Discussion of Related Art

Environmental concerns and federal regulations, such as the Clean Water Act and the accompanying National Pollution Discharge Elimination System (NPDES) Program, require construction sites, including road work projects, to control water flow to stop sediment loss and control soil erosion in and around a construction site.

The typical method currently used for controlling water flow to stop sediment loss and soil erosion is to secure one or more hay bales and/or a silt fence section in and around the construction area. While these barriers are generally effective, both can be easily compromised.

Hay bales, being a natural product, have a tendency to degrade and break down quickly and can become laden with weeds and other contaminants which can cause substantial environmental damage at the construction site. When a hay bale becomes wet, the hay material becomes heavy and bulky, making installation and removal difficult. Because hay bales are an agricultural product, hay bales are susceptible to climatic periods, and may be in short supply and difficult to obtain at a job site at certain times of the year.

Silt fencing can be effectively used at job sites when it is used for its primary purpose of preventing sediment loss. Silt fencing is designed to form a pool of water, which allows sediment to drop out. However, silt fencing is not designed to stand up against relatively high water flows. Silt fencing is susceptible to wind or other forms of weather damage. Generally, a silt fence is stapled to a stake which stuck into the ground and thus high winds or high water flow can rip the fabric from the staple or separate the staple from the stake. Once a silt fence is thus damaged, it is no longer able to protect against sediment loss.

Thus, there is a need for an improved barrier that controls water flow, sediment flow and/or prevents soil erosion in and around construction sites. Desirably, the barrier should be able to maintain integrity over time, by resisting wind, water and other forms weather related damage. There is a need for a barrier that allows construction workers to easily move the barrier to various locations, and not be heavy and bulky to handle, thereby preventing lifting related accidents and saving on freight charges. The barrier should be reusable at various construction sites. Thus, the apparatus should minimize or eliminate the chance of transporting weeds and other contaminants, because of concerns about introducing contaminants at each successive construction site.

SUMMARY OF THE INVENTION

A general object of this invention is to provide an improved barrier to reduce or eliminate soil erosion.

A more specific object of this invention is to overcome one or more of the problems previously described.

This invention relates to an apparatus for controlling water flow, soil erosion and/or sediment flow, such as along a ground surface or other surface. The apparatus includes a dam portion with a water-permeable, sediment impermeable cover enclosing a chamber, and a filler material disposed within the chamber. A rigid supporting structure is attached to the dam portion. A tail portion extends from a bottom edge of the dam portion. The supporting structure secures to the surface to hold the dam portion in an upright position, and the tail portion is disposed at an angle from the dam portion in a direction toward the flow of water.

This invention further provides an apparatus for controlling water flow, soil erosion and/or sediment flow along a surface, including a dam portion with a water-permeable, sediment impermeable cover enclosing a chamber, and a filler material disposed within the chamber. Each of two sleeves can be attached to one of opposing edges of the dam portion. A stake can be disposed through each of the sleeves and a tail portion can extend from a bottom edge of the dam portion. A support structure can be secured to the surface to hold the dam portion in an upright position, and the tail portion can be disposed at an angle from the dam portion, such as in a direction toward the flow of water.

This invention further provides a method for controlling water flow, soil erosion and/or sediment flow across a surface. The method includes providing a sediment barrier including a water-permeable, sediment impermeable cover enclosing a chamber, and disposing a filler material within the chamber. A sleeve can be attached to each of opposing edges of the dam portion, and a stake can be disposed through each of the sleeves. A tail portion can extend from a bottom edge of the dam portion. The sediment barrier can be positioned at an angle, such as perpendicular to a direction of the water flow. The sediment barrier can be secured in place by embedding an end of each of the stakes into the surface and/or extending the tail portion from the sediment barrier along the surface in a direction against the water flow.

In some embodiments, the sediment barrier of this invention has a geotextile cover over a polypropylene core material as a dam portion. The dam portion can be at least partially permeable to water, and impermeable to soil and other sediment, thereby allowing water to filter out undesired soil and other sediment. This invention can be used to pool and filter water, such as a function of the material selected as the cover and the density of the polypropylene core. A geotextile tail portion can extend from the dam portion along a section of the ground in which the barrier is placed. The tail portion can extend upstream against a direction of a flow of water. The tail portion increases the effectiveness of this invention by preventing soil and other sediment from seeping under the dam portion and undermining the purpose of the sediment barrier.

The sediment barrier of this invention can have a pair of supporting structures, such as wooden stakes, to provide vertical support and to anchor the sediment barrier in a position. The supporting structures pass through sleeves which are attached to the dam portion.

The sediment barrier of this invention controls water flow, sediment flow and/or prevents soil erosion in and around construction sites. The apparatus of this invention is able to maintain integrity over time, resisting wind, water and other forms weather related damage. The apparatus of this invention can be lightweight, allowing construction workers to easily move the apparatus to various locations. The apparatus of this invention is reusable at various construction sites and is resistant to weeds and other contaminants, lessening the possibility of introducing contaminants at successive construction sites.

BRIEF DESCRIPTION OF THE DRAWINGS

The above and other characteristics and features of this invention will be better understood from the following detailed description taken in conjunction with the drawings, wherein.

DETAILED DESCRIPTION OF THE INVENTION

Figure 1:
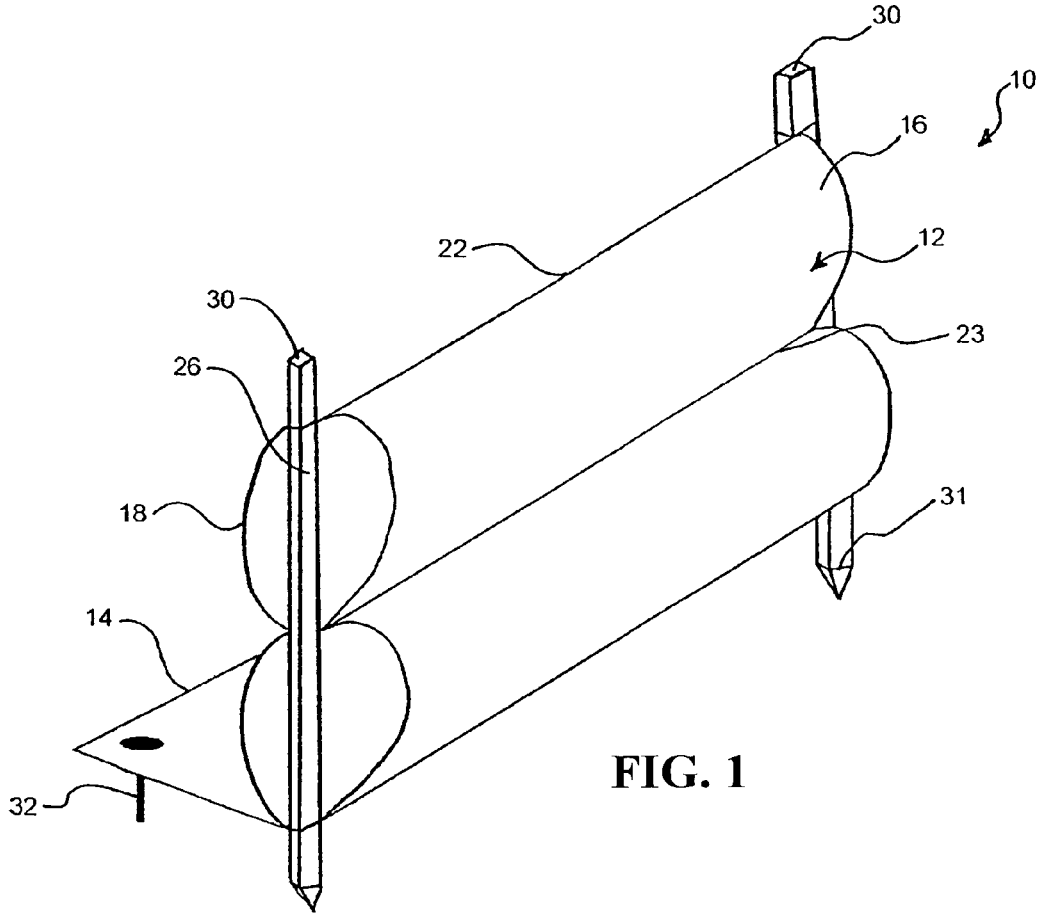
FIG. 1 is a perspective view of a sediment barrier, according to one embodiment of this invention.
Figure 2:
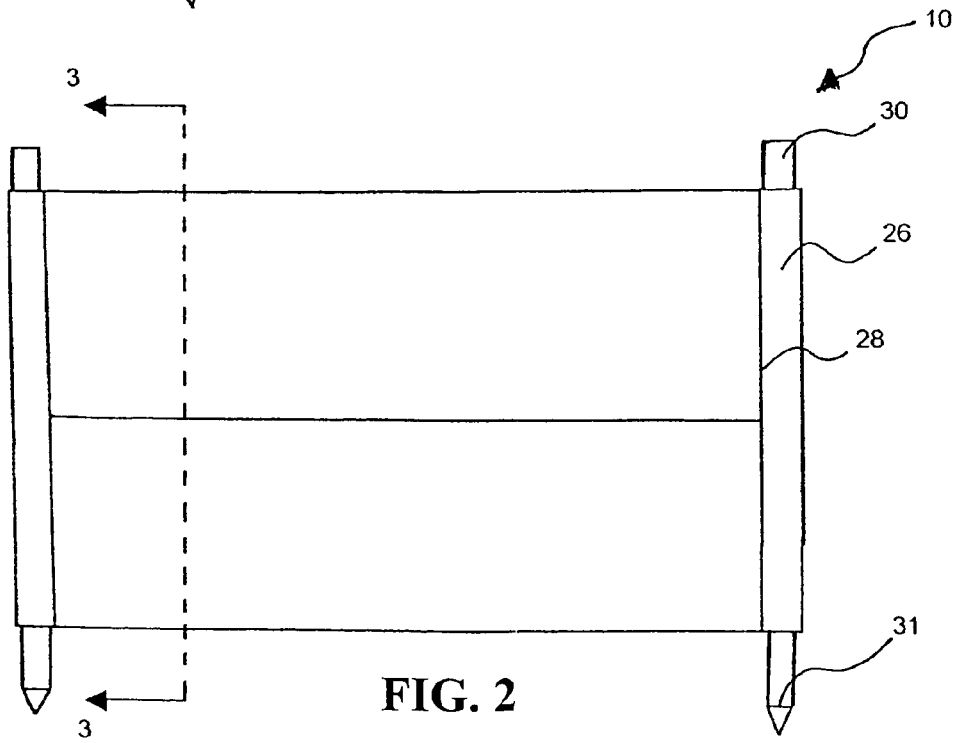
FIG. 2 is a front view of the sediment barrier as shown in FIG. 1.
Figure 3:
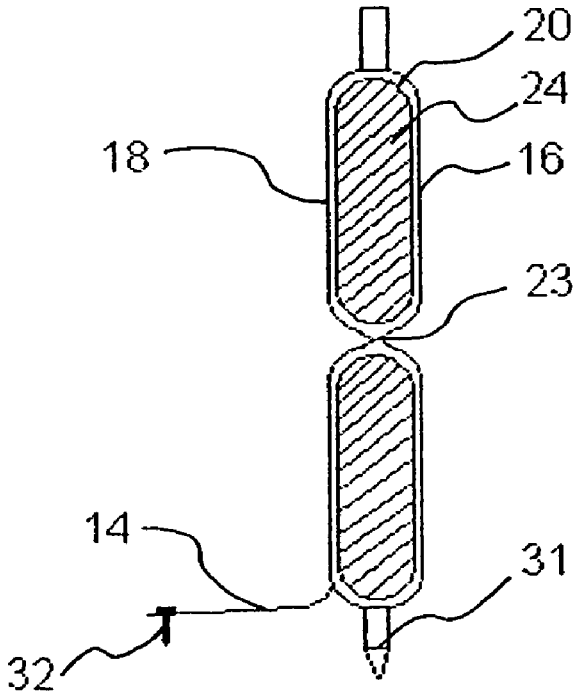
FIG. 3 is a partial sectional view of the sediment barrier shown in FIG. 1, taken along line 3-3 in FIG. 2.

FIGS. 1-3 illustrate a sediment barrier 10, according to one embodiment of this invention. The sediment barrier 10 includes or comprises a body or a dam portion 12 and a retainer or a tail portion 14. In some embodiments of this invention, dam portion 12 includes or comprises a front cover 16 and a back cover 18. The front cover 16 and/or the back cover 18 can be constructed from one or more higher-flow mono-filament geotextile fabrics, such as known to those skilled in the art of geotextile fabrics, which are generally light-weight, durable and resistant to growth of weeds and/or other contaminants. As used in this specification and in the claims, the term "geotextiles" refers to permeable fabrics which, when used in association with soil, have an ability to separate, filter, reinforce, protect and/or drain. The front cover 16 and/or the back cover 18 can be formed from rectangular shaped sheets, such as shown in FIG. 2, or from any other suitable shape. The front cover 16 and/or the back cover 18 each is joined at its edges to form at least one pocket 20, or interior volume, therebetween, and in some embodiments a plurality of pockets 20, such as shown in FIG. 3.

The front cover 16 and/or back cover 18 each can be joined along its end and side edges with a seam 22. The seam 22 can be any suitably durable conventional stitching for fabric. Alternative methods of forming the seam 22 include, but are not limited to, adhesive sealing, heat sealing and/or riveting. In other embodiments, the front cover 16 and/or the back cover 18 each is formed from a single, folded sheet of geotextile fabric which forms or defines the interior volume or pockets 20. In other embodiments, a separating seam 23 can be utilized to form more than one pocket 20. The separating seam 23 can be of any suitably durable conventional stitching for fabric.

As shown in FIG. 3, a core formed of a filler material 24 is positioned within the pocket 20. The filler material 24 can be permeable to allow water to pass and to prevent soil and other sediment from passing through the filler material 24. The filler material 24 can be constructed of a three-dimensional polypropylene, but may also be constructed of any other suitable material which can filter, for example sediment and soil from water. In some embodiments of this invention, the filler material 24 is constructed of a polypropylene material having a density from about 0.5 pounds per cubic foot to about 15.0 pounds per cubic foot. As shown in FIGS. 1-3, according to certain embodiments of this invention, the front cover 16, the back cover 18 and/or the filler material 24 can form an elliptical or a multi-elliptical shaped dam portion 12. The dam portion 12 can be formed as any other suitable three-dimensional shape, depending on the need or the intended use.

In some embodiments of this invention, the dam portion 12 comprises two sleeves 26, each disposed at one of the opposing side edges. Preferably, but not necessarily the sleeves 26 are constructed of the same material as both the front cover 16 and the back cover 18. The sleeves 26 can be joined to the dam portion 12 using a sleeve seam 28. Preferably, the sleeve seam 28 is a conventional stitching or other suitable fastener for fabric. Alternative methods for attaching a sleeve at the sleeve seam 28 includes, but is not limited to, adhesive sealing, heat sealing and/or riveting. In other embodiments, the sleeve 26 can be formed of a unitary piece of fabric or sheet material with the front cover 16 and/or the back cover 18.

The dam portion 12 can be vertically supported with one support structure 30, or a plurality of supporting structures 30. The support structure 30 can be positioned within the sleeve 26. A portion 31 of the support structure 30 can extend beyond the end of the sleeve 26. As shown in FIGS. 1-3, the portion 31 extending beyond the sleeves 26 can be embedded in the ground and/or attached to another structure to secure the sediment barrier 10 in the desired position or location. The support structure 30 can be a stake and/or any other suitable support structure, and can be constructed of any suitable material, such as a metal or a plastic.

Extending at an angle from a bottom, a bottom portion and/or a bottom edge of the dam portion 12 is the tail portion 14, which can also be referred to as a retainer, a flap or an apron. The tail portion 14 can prevent sediment from passing below, by and/or underneath the dam portion 12, which could undermine the purpose of the sediment barrier 10. The tail portion 14 can be constructed of the same material or a different material as the front cover 16 and the back cover 18. In other embodiments, the tail portion 14 can be constructed of an impermeable material, for example to filter water solely by the dam portion 12. In certain embodiments, the tail portion 14 is fixedly connected to and/or integrated with the dam portion 12.

Methods of forming the fixed connection include, but are not limited to, sewing with a thread, adhesive sealing, heat sealing and/or riveting. In other embodiments, the tail portion 14 can be detachably connected to the dam portion 12. Methods of forming the detachable connection include, but are not limited to, buttons, hook and loop fasteners, such as Velcro™ fasteners, and/or zippers. In other embodiments, the tail portion 14 and at least one of the front cover 16 and the back cover 18 is constructed from or integrally formed as a single piece or an integrated piece of fabric.

Figure 4:
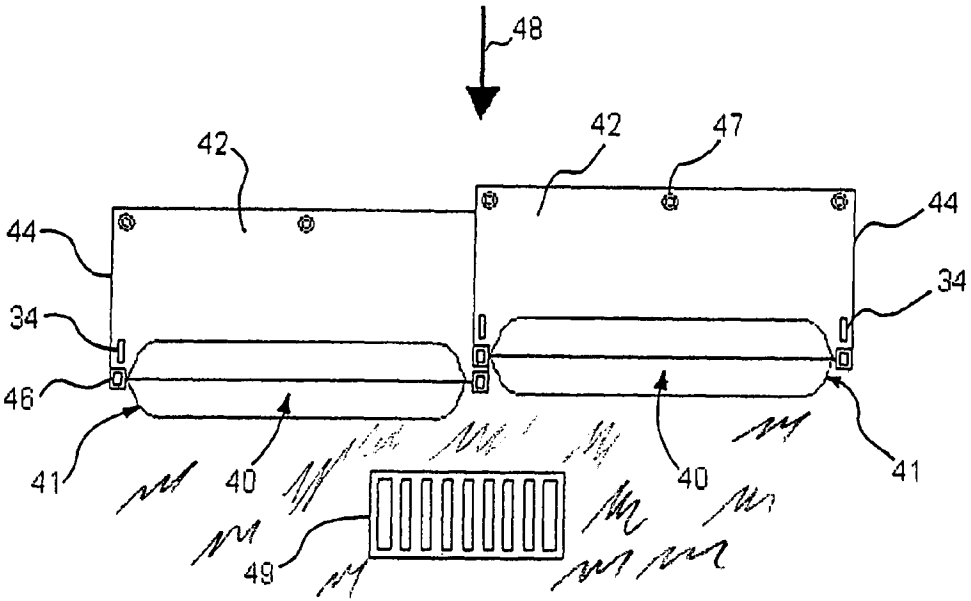
FIG. 4 is a top view of two sediment barriers connected in a staggered formation, according to one embodiment of this invention.

As shown in FIGS. 1-3, the tail portion 14 is secured or fixed in position with at least one securing pin 32 inserted into or attachable to the ground. Any number of securing pins can be used, such as two or three pins, for each tail portion 14. Securing pins 32 are preferably but not necessarily made of metal or plastic. As shown in FIG. 4, the tail portion 14 can include riveted holes 47 or another suitable structure through which the securing pin 32 can pass. In other embodiments, the securing pins 32 can pierce or puncture through the tail portion 14. In alternative embodiments, the securing pins 32 are replaced by soil, sand, gravel, bricks and/or any other suitably heavy object. Often, as the sediment barrier 10 is used, sediment will build up on the tail portion 14 and thus further secure or fix the tail portion 14 in position.

In accordance with some embodiments of this invention, the sediment barrier 10 can be used alone or in combination with one or more additional sediment barriers 10, for example to protect a site.

FIG. 4 shows two sediment barriers 40 assembled according to one embodiment of this invention. FIG. 4 shows a top view of a pair of sediment barriers 40 connected in a staggered formation. Any other staggered configuration is possible. The tail portions 42 of the sediment barrier 40 can include or form one or more slits 34. Each of the slits 34 is disposed along a side edge 44 of the tail portion 42. The slits 34 allow the support structure 46 from an adjacent sediment barrier 40 to easily pass through the tail portion 42, thereby allowing for the staggered relative placement as shown in FIG. 4, or otherwise, to create an overlapping sediment barrier structure. In other embodiments, the sleeves 26 of adjacent sediment barriers 10 can be configured to accommodate a single shared supporting structure between the sleeves 26.

Figure 5:
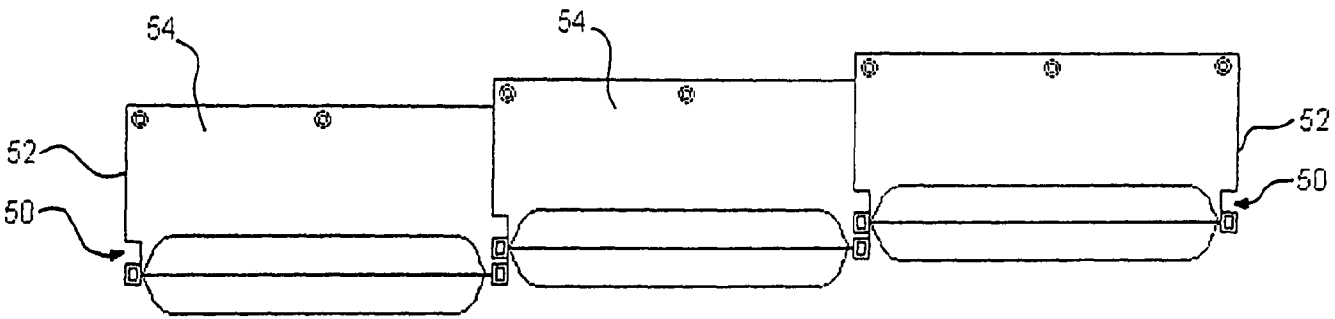
FIG. 5 is a top view of three sediment barriers connected in a staggered formation, according to another embodiment of this invention.

Various and alternative configurations are available for the slits 34 according to this invention. For example, each slit 34 can be a simple cut in the fabric of the tail portion 14, optionally reinforced by threads, such as a button hole, or the slit 34 can be a shaped cut, such as a rectangle shown in FIG. 4, or other shapes depending on a need, such as depending on the size and shape of the support structure extending therethrough. FIG. 5 illustrates yet another embodiment of this invention, showing the slits 34 as notches 50 cut out from the edges 52 of the tail portions 54.

To utilize the sediment barriers 40 in FIG. 4, for example, to protect a water drainage grate 49 from receiving undesirable amounts of sediment, the dam portion 41 can be placed at a general angle, such as generally perpendicular to a water flow direction, shown by arrow 48, with the tail portions 42 placed upon the ground and extending in a direction against the direction of the water flow and/or the sediment flow 48. Water can pass through the sediment barrier 40 and into the grate 49 while preventing soil and/or other sediment from passing through and instead to build materials upon the tail portions 42 of each sediment barrier 40.

Thus, this invention also relates to a method of controlling water flow, soil erosion and/or sediment flow across a surface. The sediment barriers 40 can be desirably aligned, such as generally perpendicular to an expected direction of the water flow and secured in place by embedding an end of each of the stakes 30 into the surface. The tail portions can extend from the sediment barrier 40 along the surface, such as the ground, in a direction against the water flow and/or the sediment, such as shown in FIG. 4.

An end of a stake of a second sediment barrier 40 can be inserted through the slit 34 in the tail portion of the first sediment barrier 40, and the second sediment barrier 40 can be secured in place by embedding an end of each of the second stakes into the surface. Construction of an overall barrier structure can be continued by similarly inserting an end of one stake of a third sediment barrier through the slit in the tail portion of the second sediment barrier. In this manner, the sediment barriers of this invention provide the ability to construct an overall barrier structure having the necessary and suitable size and shape for any given site.

Details of the discussed embodiments are given for purposes of illustration and are not to be construed as limiting the scope of this invention. Although only a few exemplary embodiments of this invention are described in detail above, those skilled in the art will readily appreciate that many modifications are possible in the exemplary embodiments without materially departing from the novel teachings and advantages of this invention. Accordingly, all such modifications are intended to be included within the scope of this invention. Further, it is recognized that many embodiments may not achieve all of the advantages of some embodiments, yet the absence of a particular advantage shall not be construed to necessarily mean that such an embodiment is outside the scope of this invention.

What is claimed is:

1. An apparatus for controlling a sediment flow along a surface, the apparatus comprising:

a body of a water-permeable and sediment impermeable fabric material forming two chambers joined by a separating seam in the fabric material, the body further including a filler material disposed within each of the two chambers;

a support structure connected to the body;

a retainer attached to and extending from a base of the body; and the support structure fixable to the surface and supporting the body upright with a first of the two chambers vertically disposed above a second of the two chambers, and the retainer extending from the base of the body toward the sediment flow.

2. The apparatus of claim 1, wherein the water-permeable and sediment impermeable fabric material comprises a geotextile fabric.

3. The apparatus of claim 1, wherein the filler material comprises a polypropylene material.

4. The apparatus of claim 3, wherein the polypropylene material has a density from about 0.5 pounds per cubic foot to about 15.0 pounds per cubic foot.

5. The apparatus of claim 1, wherein the support structure comprises a stake fixable to the surface.

6. The apparatus of claim 1, further comprising a securing pin connectible to the retainer.

7. The apparatus of claim 1, wherein the retainer has a panel with at least one slit positioned along an edge of the retainer.

8. The apparatus of claim 7, wherein the slit is formed as a notch within the retainer.

9. An apparatus for controlling a sediment flow along a surface, the apparatus comprising:

a dam formed of a water-permeable and sediment impermeable fabric material forming two chambers joined by a separating seam in the fabric material, the dam further including a filler material disposed within each of the two chambers;

two sleeves, each of the two sleeves attached to one of opposing edges of the dam;

two stakes, each of the two stakes attachable within a corresponding sleeve of the sleeves;

a retainer extending from a lower edge of the dam, the retainer including a slit disposed along a side edge of the retainer and for receiving a stake of a second apparatus for controlling a sediment flow along the surface; and the two stakes fixable to the surface to hold the dam in an upright position, and the retainer positioned away from the dam toward the sediment flow.

10. The apparatus of claim 9, wherein the cover fabric material comprises a geotextile fabric.

11. The apparatus of claim 9, wherein the filler material comprises a polypropylene material.

12. The apparatus of claim 11, wherein the polypropylene material has a density from about 0.5 pounds per cubic foot to about 15.0 pounds per cubic foot.

13. The apparatus of claim 9, further comprising a securing pin connectible to the retainer.

14. The apparatus of claim 9, wherein the slit is formed as a notch within the retainer.

15. A method for controlling a sediment flow across a surface, the method comprising:

providing two barriers each including a dam including a water-permeable and sediment impermeable fabric material forming two chambers joined by a separating seam in the fabric material, the dam further including a filler material disposed within each of the two chambers, a sleeve attached to each of opposing edges of the dam, a stake attached to each of the sleeves, and a tail portion extending from a bottom of the dam;

aligning a first of the two barriers in a direction of the sediment flow;

securing the first of the two barriers in position with stakes attachable into the surface;

extending the tail portion from the first of the two barriers along the surface toward the sediment flow; and overlapping a second of the two barriers with the first of the two barriers by:

inserting a stake of a second of the two barriers through a slit in the tail portion of the first of the two barriers; and securing the second of the two barriers in position with stakes attachable into the surface.

16. The method of claim 15, wherein the tail portion is secured to the surface by passing a pin through the tail portion and into the surface.

17. The method of claim 15, further comprising:

extending the tail portion from the second of the two barriers along the surface toward the sediment flow, and overlapping a portion of the tail portion of the first of the two barriers with a portion of the tail portion of the second of the two barriers.

* * * * *

UNITED STATES PATENT AND TRADEMARK OFFICE

CERTIFICATE OF CORRECTION

PATENT NO. : 8,100,609 B2
APPLICATION NO. : 12/378159
DATED : January 24, 2012
INVENTOR(S) : Ken Wilson It is certified that error appears in the above-identified patent and that said Letters Patent is hereby corrected as shown below:

In the Claims

Column 6, Claim 10, line 59, delete "cover"

Signed and Sealed this
Twenty-seventh Day of May, 2014

Michelle K. Lee

Michelle K. Lee
*Deputy Director of the United States Patent and Trademark Office*